United States Patent [19]

Thomas

[11] Patent Number: 4,623,781

[45] Date of Patent: Nov. 18, 1986

[54] DOUBLE WALL OVEN WITH SAFE LIMIT TEMPERATURE CONTROL

[75] Inventor: Calvin J. Thomas, Orefield, Pa.

[73] Assignee: Raytheon Company, Lexington, Mass.

[21] Appl. No.: 699,614

[22] Filed: Feb. 8, 1985

[51] Int. Cl.[4] ..... H05B 1/02

[52] U.S. Cl. ..... 219/413; 126/273 R; 219/394; 219/398; 219/483

[58] Field of Search ..... 219/413, 394, 395, 398, 219/483, 486, 492, 493; 126/273 R, 21 R, 21 A

[56] References Cited

U.S. PATENT DOCUMENTS

| | | | |
|---|---|---|---|
| 1,758,619 | 5/1930 | Phillips | 219/493 |
| 2,742,557 | 4/1956 | Macoicz | 219/412 |
| 2,828,404 | 3/1958 | Long | 219/394 |
| 3,899,656 | 8/1975 | Smith | 219/413 |
| 4,313,052 | 1/1982 | Fischer | 219/486 |

FOREIGN PATENT DOCUMENTS

| | | | |
|---|---|---|---|
| 1443184 | 7/1976 | United Kingdom | 219/398 |

*Primary Examiner*—E. A. Goldberg
*Assistant Examiner*—Teresa J. Walberg
*Attorney, Agent, or Firm*—William R. Clark

[57] ABSTRACT

An electric double oven having two self-cleaning cavities, one cavity also having microwave capability wherein forced air from a blower repels hot self-clean air from entering the waveguide. A circuit is provided for limiting the temperature of either cavity to approximately 505° F. when the other cavity is above a temperature associated with self-cleaning. The circuit also limits the common microwave cavity to approximately 505° F. when the blower is not functioning so that oven cavity air entering the waveguide will not present a hazard.

17 Claims, 6 Drawing Figures

DOUBLE WALL OVEN WITH SAFE LIMIT TEMPERATURE CONTROL

BACKGROUND OF THE INVENTION

The general field of the invention relates to a pair of adjacently located self-cleaning ovens, commonly referred to as a double oven.

There are several reasons why both oven cavities of a double oven should not be self-cleaned simultaneously. First, double ovens are commonly installed one on top of the other in a kitchen wall, such that the upward hot air convection and heat conduction resulting from simultaneous self-cleaning could create an outside wall temperature that might exceed safety standards. Second, the electrical components of a double oven are typically mounted on top and excessive heat may induce component failures. Third, the power requirements to provide simultaneous self-cleaning may exceed typical house wiring limitations.

The prior art approach was to use a controller or control to prevent simultaneous self-cleaning. An oven controller or control totally disabled one oven when the adjacent oven was self-cleaning, thus foregoing the use of either oven for cooking. In a variation of the above approach, a control was used only to disable self-clean mode in one oven when the adjacent oven was self-cleaning. The non-cleaning oven could therefore be used for thermal cooking.

A disadvantage with the prior art approach is that failure modes of a controller or control may result in potentially hazardous simultaneous self-cleaning. Further, devices responsive to controllers may fail resulting in simultaneous self-cleaning.

Controller failure modes may also cause another problem during self-cleaning of an oven cavity having microwave capability. In a common cavity oven it has been conventional for a waveguide to couple the magnetron to the back wall of an oven. It has also been conventional to direct magnetron blower air into the oven cavity, through the waveguide, for forcing air out of the oven cavity while cooking in microwave mode. During self-cleaning, however, rising hot air could enter the waveguide overheating microwave components contained therein. A prior art approach to prevent this problem was for an oven controller or control to activate the blower during self-cleaning to resist hot air from entering the waveguide. Again, controller or control device failure may result in component failures and associated hazards.

As operating modes of modern ovens become more numerous, the possibility of encountering unwanted and hazardous combinations of operating modes increases. Consequently, reliance only on controllers to avoid hazardous operating modes is becoming increasingly risky.

SUMMARY OF THE INVENTION

It is one object of the invention to prevent simultaneous self-cleaning of a pair of adjacently located self-cleaning ovens, independently of the oven controller and independently of operator self-cleaning settings.

It is another object of the invention to enable the use of the first oven for cooking when the second oven is self-cleaning.

It is a further object of the invention to limit the first oven to a safe temperature which is sufficient for thermal cooking when the second oven is at a self-cleaning temperature.

It is also an object of the invention to limit an oven to a desired temperature for self-cleaning by pyrolysis.

It is an additional object of the invention to detect when the magnetron blower is not on in a combination thermal-microwave oven and then to limit the oven to a safe temperature.

These and other objects are realized in accordance with the present invention which defines a double oven comprising a first oven cavity, a source of thermal energy for heating the first oven cavity for cooking and self-cleaning, a second oven cavity adjacent the first oven cavity, a source of thermal energy for heating the second oven cavity for cooking and for self-cleaning, a temperature sensor coupled to the second oven cavity, and means responsive to the second oven cavity temperature sensor for preventing the first oven cavity from rising above a first predetermined temperature when the second oven cavity is above a second predetermined temperature. It may preferable that the double oven includes a means for providing the preventing means with a signal when the first oven cavity rises above a first predetermined temperature, the providing means being coupled to the first oven cavity. The first source of thermal energy may preferably be an electric heating element positioned in the first oven cavity, and the second source of thermal energy may preferably be an electric heating element positioned in the second oven cavity. It may also be preferable that the preventing means be a switch for disabling the first electric heating element. Preferably, the double oven may include an operator actuable control having a first setting corresponding to self-cleaning in the first oven cavity and a second setting corresponding to self-cleaning in the second oven cavity, the first and second settings not being simultaneously actuable. The first oven cavity may preferably be positioned above the second oven cavity, thereby providing an oven that is particularly suited for mounting in a wall.

The invention may further be defined by a double wall oven comprising a first oven cavity, an electric heating element positioned in the first oven cavity, a second oven cavity adjacent to the first oven cavity, an electric heating element positioned in the second oven cavity, a controller comprising means for controlling activation of the first oven cavity electric heating element and the second oven cavity electric heating element for cooking and self-cleaning, the controller further comprising means responsive to the second oven cavity temperature sensor for providing a signal when the second oven cavity rises above a predetermined temperature, and means responsive to the signal for disabling the first oven cavity electric heating element at a predetermined temperature in the first oven cavity, the disabling means also disabling the first oven cavity electric heating element at an upper limit self-cleaning temperature in the first oven cavity which may preferably be 925° F., the disabling means comprising a switch. The double wall oven may preferably have means for coupling a second signal to the disabling means when the first oven cavity rises above the predetermined temperature in the first oven cavity, the coupling means also coupling a third signal to the disabling means when the first oven cavity rises above the upper limit self-cleaning temperature, the coupling means being coupled to the first oven cavity. It may be preferable for the controller to include means for preventing activation of the first oven cavity electric heating element for self-cleaning when the second oven cavity electric heating element has been activated for self-cleaning. The double wall oven may preferably have the first oven cavity above the second oven cavity.

The invention further defines a double wall oven comprising a first oven cavity having an air inlet port, an electric heating element positioned in the first oven cavity for cooking and self-cleaning, a magnetron, a waveguide for coupling microwave energy from the magnetron to the air inlet port, a blower for forcing air across the magnetron, through the waveguide, through the air inlet port into the first oven cavity, a second oven cavity adjacent to the first oven cavity, an electric heating element positioned in the second oven cavity for cooking and self-cleaning, a controller for controlling activation of the electric heating elements, the magnetron and the blower, the controller further comprising a means responsive to the temperature sensor for providing a first signal when the second oven cavity rises above a predetermined temperature which may preferably be 600° F., means for providing a second signal when air flow from the blower is absent, and a means responsive to the second signal for disabling the first oven cavity electric heating element at a predetermined first oven cavity temperature when blower air is absent, the disabling means also being responsive to the first signal for disabling the first oven cavity electric heating element at the predetermined first oven cavity temperature, the disabling means also disabling the first oven cavity electric heating element at an upper limit self-cleaning temperature in the first oven cavity, the disabling means comprising a switch. It may be preferable that the double oven have means for coupling a third signal to the disabling means when the first oven cavity rises above the predetermined first oven cavity temperature which may preferably be approximately 505° F., the coupling means also coupling a fourth signal to the disabling means when the first oven cavity rises above the upper limit self-clean temperature which may preferably be approximately 925° F., the coupling means being coupled to the first oven cavity. The controller may preferably activate the blower during self-cleaning of the first oven cavity to resist hot self-clean air from entering the waveguide. The double oven may preferably comprise a back wall, a top wall, a bottom wall, and two side walls, the air inlet port being in the back wall. It may also be preferable for the double oven to have an operator actuable control coupled to the controller, the control having a first setting corresponding to self-cleaning in the first oven cavity and a second setting corresponding to self-cleaning in the second cavity, the first and second settings not being simultaneously actuable. In accordance with the invention, the disabling means may limit the first oven cavity to either approximately 505° F. or 925° F. by disabling the first oven cavity heating element, in response only to: the first signal from the controller, the second signal from the providing means, and the third and fourth signals from the coupling means. The switch functions independently of operating modes selected by the control panel and/or controller. For example, the disabling means may limit the first oven cavity to an upper self-clean temperature of approximately 925° F. in response to the fourth signal from the coupling means. The disabling means may also limit the first oven cavity to a temperature of approximately 505° F. in response to the presence of both the first signal from the controller and the third signal from the coupling means. That is, when the second oven cavity is at or above a temperature of approximately 600° F. and the first oven cavity is at or above approximately 505° F., the disabling means disables the first cavity electric heating element. Further, the disabling means will also limit the first oven cavity to a temperature of approximately 505° F. in response to both the second signal from the providing means and the third signal from the coupling means. That is, when air from the blower is not detected and the first oven cavity is at or above a temperature of approximately 505° F., the disabling means disables the first cavity heating element.

The invention further defines a double wall oven comprising a first oven cavity, a source of thermal energy for heating the first oven cavity for cooking and self-cleaning, a second oven cavity located above the first oven cavity, a source of thermal energy for heating the second oven cavity for cooking and self-cleaning, a temperature sensor coupled to the second oven cavity, and means responsive to the temperature sensor for disabling the first oven cavity source of thermal energy at a first predetermined temperature in the first oven cavity when the second oven cavity rises above a second predetermined temperature in the second oven cavity. In accordance with the defined structure, the double oven may comprise a free-standing double oven, commonly referred to as a double decker.

The invention further may be practiced by the method of preventing a first oven from self-cleaning when an adjacent second oven is self-cleaning, comprising the steps of detecting when the second oven rises above a first predetermined temperature corresponding to self-cleaning, and limiting the first oven to a second predetermined temperature in response to detecting the second oven above the first predetermined temperature.

BRIEF DESCRIPTION OF THE DRAWINGS

The objects and advantages described herein will be more fully understood by reading the Description of the Preferred Embodiment with reference to the drawings wherein.

DESCRIPTION OF THE PREFERRED EMBODIMENT

Figure 1:
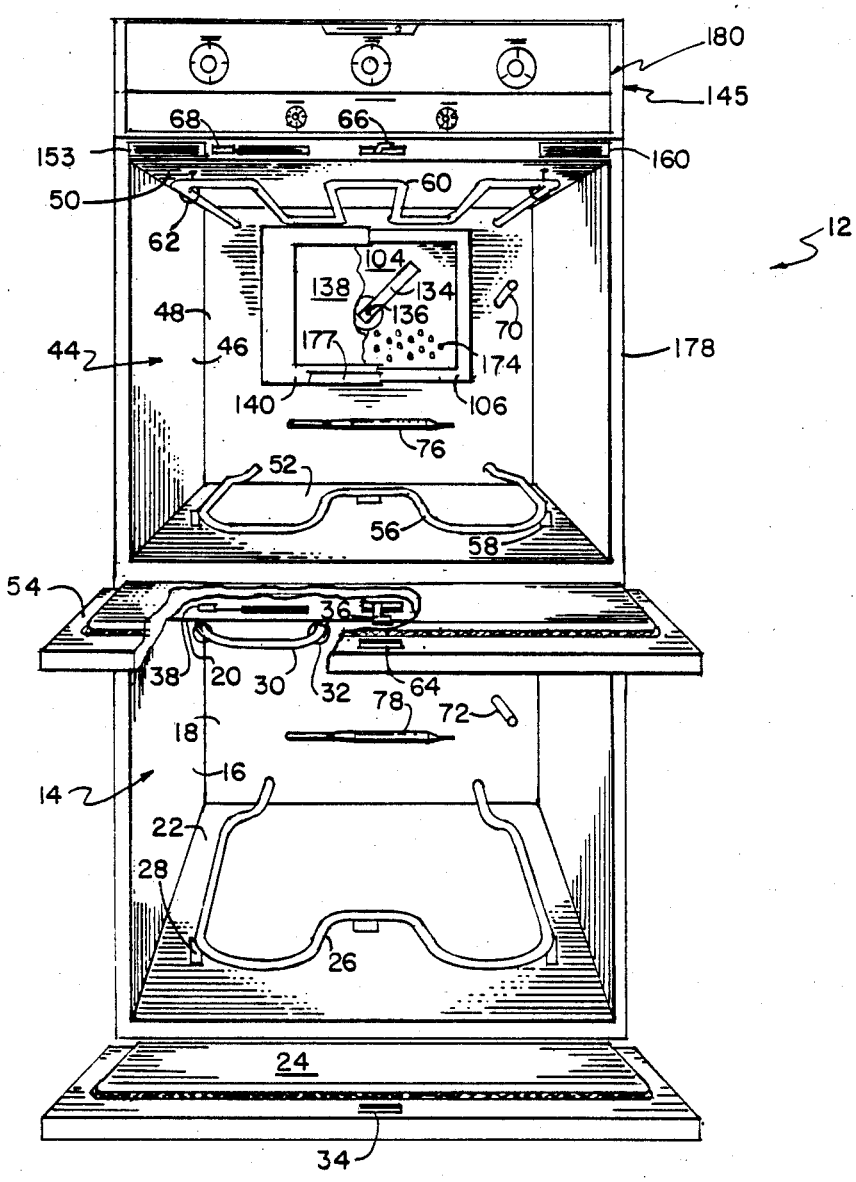
FIG. 1 is a front perspective view of a double wall oven in which the present invention is used to advantage.

Referring first to FIG. 1, double wall oven 12 is shown. Although oven 12 is adapted for mounting into a kitchen wall, those skilled in the art will recognize that the invention may also be used to advantage in other applications such as a free-standing double oven, commonly referred to as a double decker. It is also noted that although FIG. 1 illustrates two electric ovens, with one having microwave capability, principles described herein may be applied in ovens without microwave capability or ovens having sources of thermal energy other than electric heating elements, such as, for example, natural gas or propane.

Double wall oven 12 has a lower oven cavity 14 for cooking food by thermal energy alone. Cavity 14 is defined by side walls 16, back wall 18, ceiling 20, floor 22 and door 24. Thermal energy is provided by conventional electric bake heating element 26, here shown supported horizontally adjacent to floor 22 by stands 28. Also, a conventional electric broil heating element 30 is suspended in a horizontal plane adjacent to ceiling 20 by brackets 32. In addition to electric heating element 26 and/or 30 providing thermal energy for cooking, one or both of them are also used to heat cavity 14 to approximately 925° F. for self-cleaning by pyrolysis. Door 24 is provided with a latching receptacle 34 which is suitable for latching with latching member 36. Latching handle 38 manipulates latching member 36 for operator latching of door 24 before initiation of self-cleaning.

Still referring to FIG. 1, double wall oven 12 has an upper oven cavity 44 for cooking food by thermal energy alone, microwave energy alone, or a combination of thermal and microwave energy. Cavity 44 is defined by side walls 46, back wall 48, ceiling 50, floor 52 and door 54. Associated with cavity 44 are bake heating element 56, support stands 58, broil heating element 60, brackets 62, latching receptacle 64, latching member 66 and latching handle 68, which have similar functions to their corresponding parts of lower oven cavity 14. Coupled to back wall 48 are microwave transparent cover 138, cover frame 140, radiating antenna 134, box 104, flange 106, perforations 174 and air passageway 176 (FIG. 4) under lip 177 of cover frame 140, which will be discussed with reference to FIGS. 3 and 4.

Upper oven temperature sensor 70 and lower oven temperature sensor 72, each of which may typically define a temperature bulb or thermocouple, provide controller 74 (FIG. 6) with an indication of temperature for cavities 44 and 14, respectively. Upper oven limit temperature sensor 76 and lower oven limit temperature sensor 78, each of which may define a capillary tube, respectively provide upper oven limit temperature control 80 (FIG. 6) and lower oven limit temperature control 82 (FIG. 6) with indications of various limiting temperatures in cavities 44 and 14.

Figure 2:
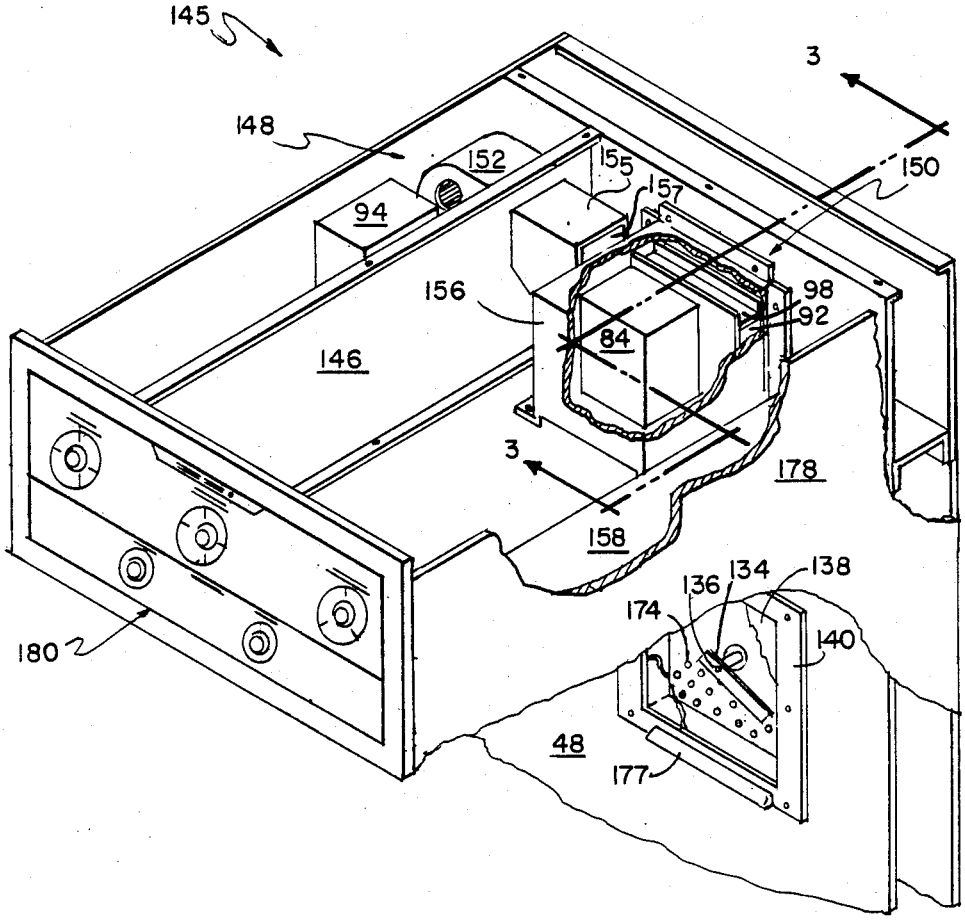
FIG. 2 is a partially broken away top perspective view of a portion of the back wall of the upper oven and the chamber thereabove.
Figure 3:
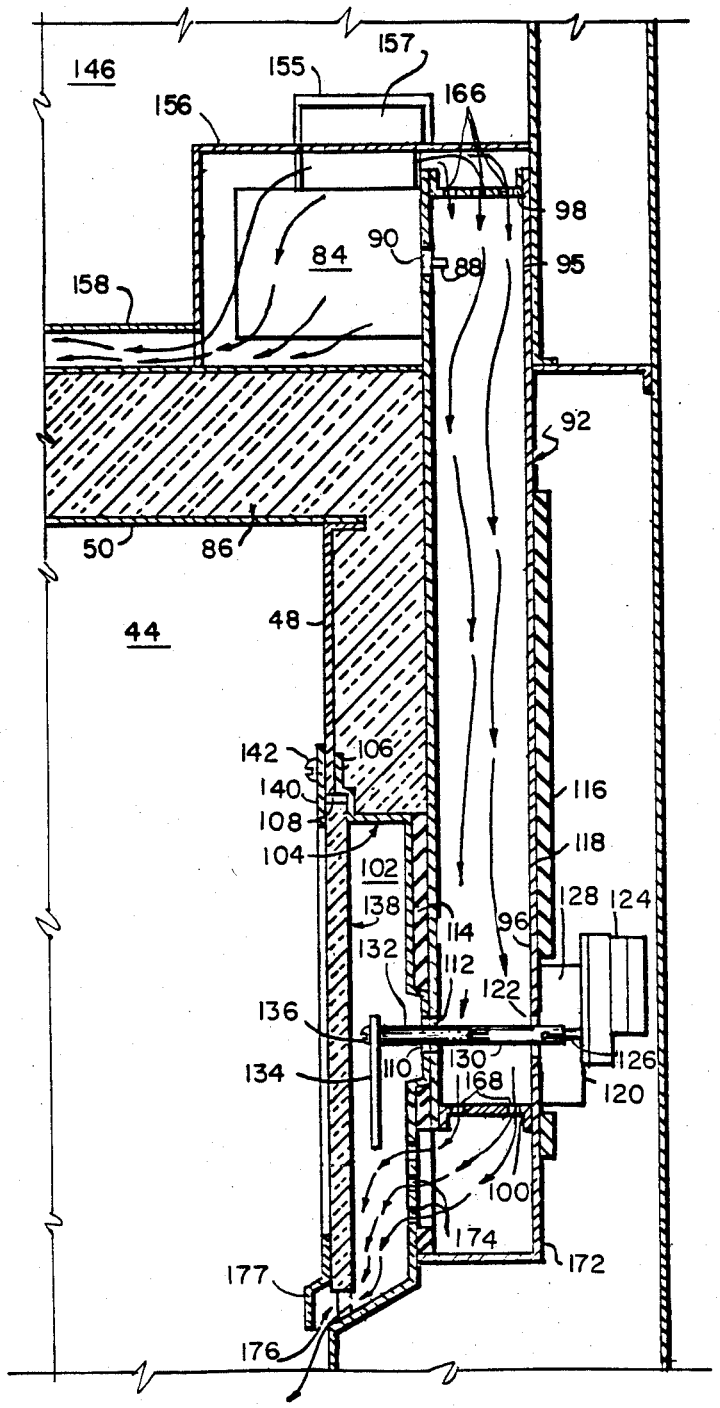
FIG. 3 is a view taken along line 3—3 of FIG. 2.
Figure 4:
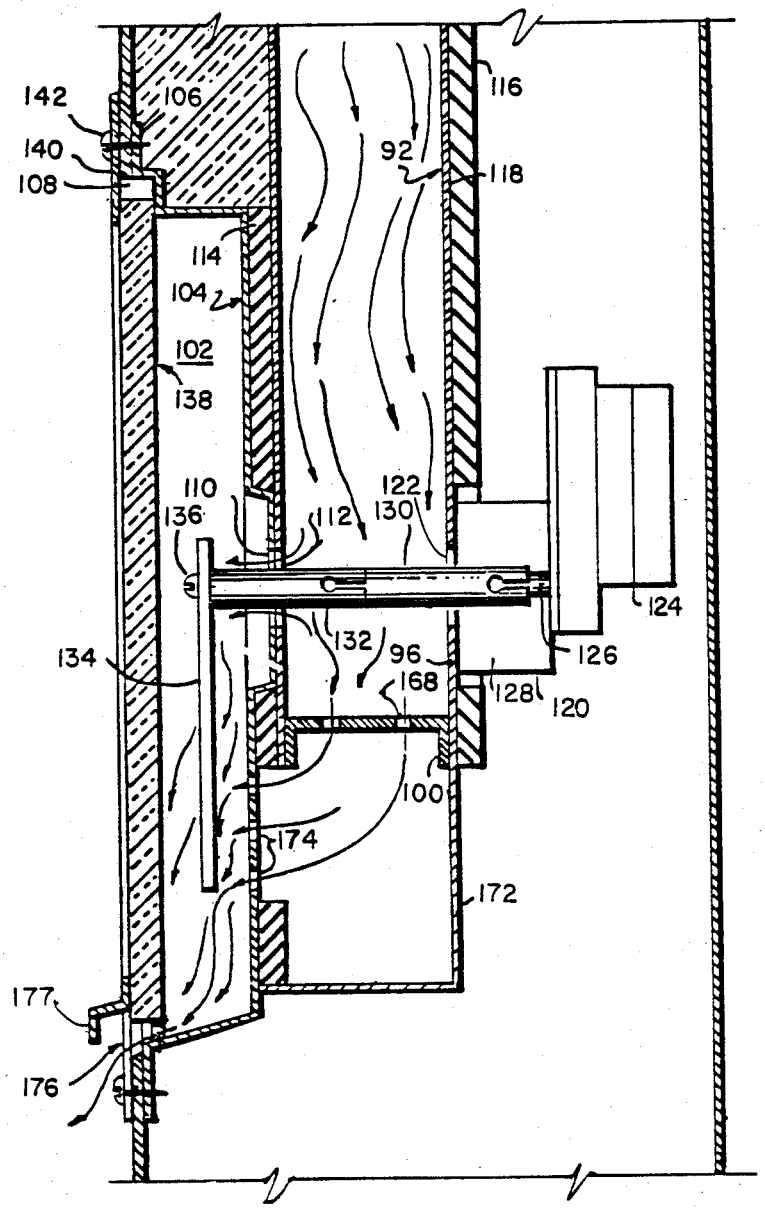
FIG. 4 is an expanded view of the lower region of FIG. 3.

Reference is now made to FIG. 2 which is a perspective view of chamber 145 located above upper cavity ceiling 50, FIG. 3 which is a side sectional view of a portion of oven cavity 44, and FIG. 4 which is an expanded view of the lower region of FIG. 3. Magnetron 84 is positioned above insulation 86, adjacent oven cavity ceiling 50 and provides microwave energy having a frequency such as, for example, 2450 MHz. The output probe 88 of magnetron 84 is inserted through circular hole 90 in waveguide 92. In response to power supply 94 being activated, output probe 88 excites rectangular waveguide 92 with microwave energy which propagates from the source end 95 to the cavity feed end 96. Waveguide shorts 98 and 100 prevent microwave energy from escaping the ends of waveguide 92. Cavity 44 has a recess 102 in the back wall 48 formed by box 104 which preferably has a flange 106 which is welded around the perimeter of cut-out 108 in the back wall 48 of cavity 44. Box 104 and the cavity feed end 96 of waveguide 92 each have circular apertures 110 and 112, respectively, which align to each other. A thermal gasket 114 may preferably be seated between the corresponding surfaces of box 104 and waveguide 92 as shown. Also, thermal gasket 116 may preferably be secured to the back side 118 of waveguide 92. Motor mounting bracket 120 is connected to the back side 118 of waveguide 92 and covers a hole 122 in waveguide 92 which aligns with circular apertures 110 and 112. Motor 124 has a shaft 126 which inserts through motor mounting bracket 120 into the space 128 defined between the back side 118 of waveguide 92 and motor mounting bracket 120. Connected to motor shaft 126 is a microwave transparent drive shaft 130 which extends into waveguide 92 through hole 122 and which may preferably be fabricated from a plastic such as Teflon. By being made of a microwave transparent material, drive shaft 130 does not serve as a center conductor for supporting microwave leakage through hole 122. Rod 132 is made of a metal such as aluminum and is rigidly connected by suitable means such as screwing drive shaft 130 into a threaded bore of rod 132. Rod 132 projects horizontally through circular apertures 110 and 112 into recess 102. A radiating finger or antenna 134 is connected to rod 132 by a suitable means such as bolt 136. Microwave energy couples to rod 132 which functions as a receiving probe antenna and a center conductor to radiating antenna 134. Radiating antenna 134 couples microwave energy into oven cavity 44 through high temperature resistant microwave transparent cover 138. Cover frame 140 and flange 106 secure cover 138 in recess 102 of back wall 48. Cover frame 140 is secured to back wall 48 by suitable means, here screws 142, around its periphery.

Figure 6:
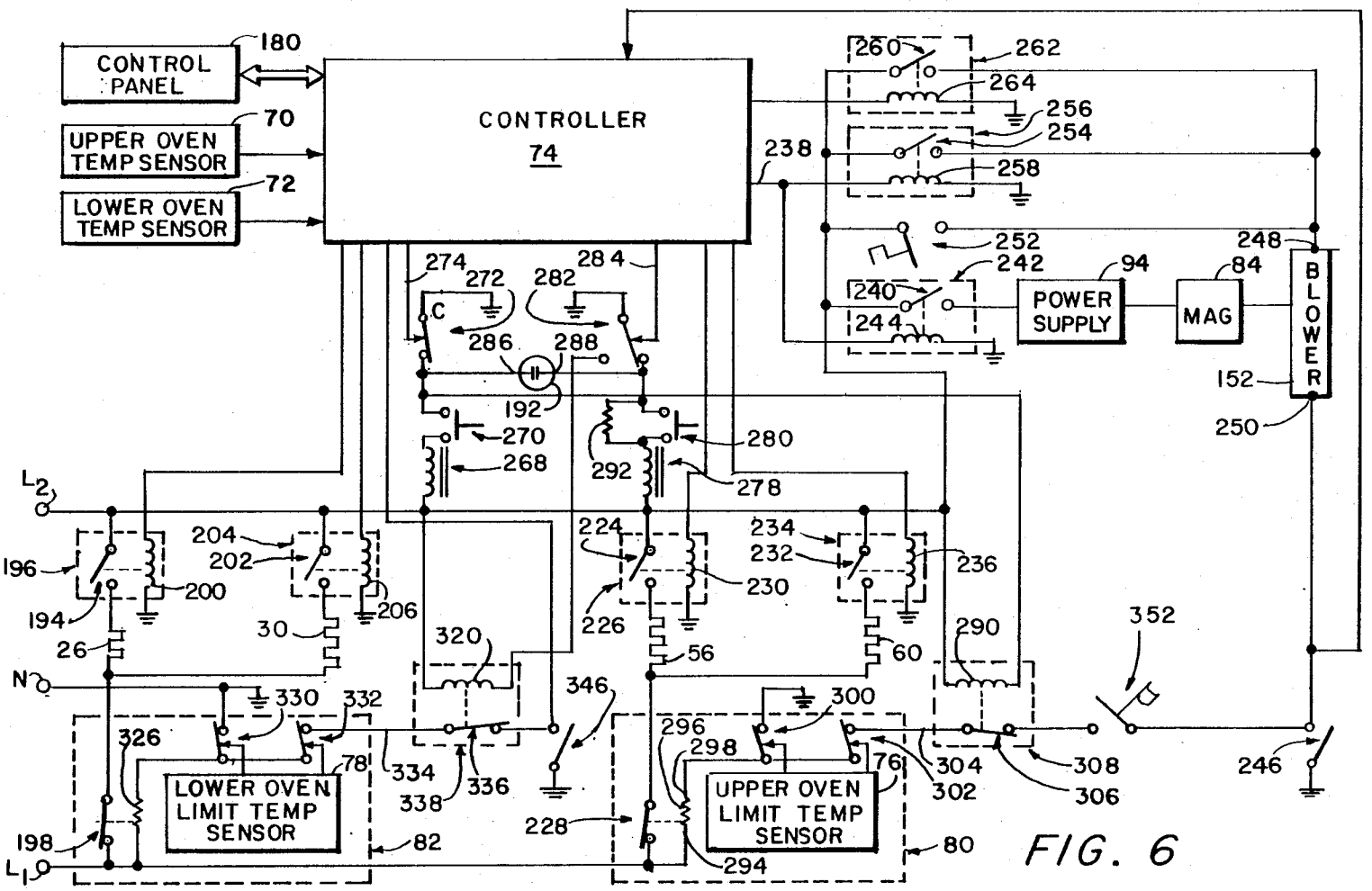
FIG. 6 is a schematic diagram of a control circuit for the double wall oven of FIG. 1.

Chamber 145 above ceiling 50 is divided by partition 146 into compartments 148 and 150 as shown in FIG. 2. Blower 152 and power supply 94 are contained in compartment 148. Magnetron 84, source end 95 of waveguide 92 and a portion of the electrical components illustrated in FIG. 6 are contained in compartment 150. Other electrical components may also be housed in compartment 150 but are not shown because a detailed description of them is not necessary for an understanding of the invention. Blower 152 draws air from inlet vent 153 (FIG. 1) across power supply 94 and expells air through chute 155 which leads to magnetron enclosure 156 located in compartment 150. Upper portion 157 of chute 155, which is positioned above the magnetron enclosure 156, may preferably be open directing a portion of the forced air into compartment 150. Power supply 94, magnetron 84 and compartment 150 are thereby cooled by forced air flowing to or from blower 152. Air entering magnetron enclosure 156 exits through two separate paths. One path exits through exhaust duct 158 and oven exhaust vent 160 (FIG. 1). The other path is through waveguide 92 as described below.

Air enters waveguide 92 from magnetron enclosure 156 through perforations 166 in waveguide short 98, as illustrated in FIG. 3. Perforations 166, and all other perforations referred to herein, are of a diameter below microwave cut-off thereby allowing air to pass therethrough while preventing the escape of microwave energy. The forced air in waveguide 92 passes past magnetron output probe 88 providing some cooling thereof and then out perforations 168 in waveguide short 100. Some of the forced air also exits waveguide 92 along rod 132 through circular apertures 110 and 112 into recess 102. The air exhausting waveguide 92 through perforations 168 also enters recess 102 as it is directed through duct 172 and perforations 174 which function as an air input port to cavity 44. The forced air passes from recess 102 into cavity 44 via passageway 176 under lip 177 of cover frame 140. As will be described in detail with reference to FIG. 6, blower 152 is activated whenever magnetron 84 is activated and also during self-cleaning of cavity 44. During microwave operation, the flow of air into and through cavity 44 functions in a conventional manner to remove moisture. An exhaust duct coupled between ceiling 50 of cavity 44 and oven exhaust vent 160, for conventionally removing a portion of cavity 44 air, is not shown because a detailed description is not necessary for an understanding of the invention. In self-clean operation, the flow of air down waveguide 92 prevents the very hot air in cavity 44 from flowing up waveguide 92 thereby overheating and damaging components, such as, for example, drive shaft 130, rod 132 and motor 124. In addition, self-clean air from cavity 44 is prevented from rising into, and heating, compartment 150 through waveguide 92. Compartment 150, however, is also heated by heat conduction through outer walls 178 during self-cleaning. This potential problem is solved by directing a portion of air from blower 152 directly into compartment 150. Components contained therein, such as, for example, a portion of components illustrated in FIG. 6 are thereby cooled and hazardous failures prevented.

Figure 5:
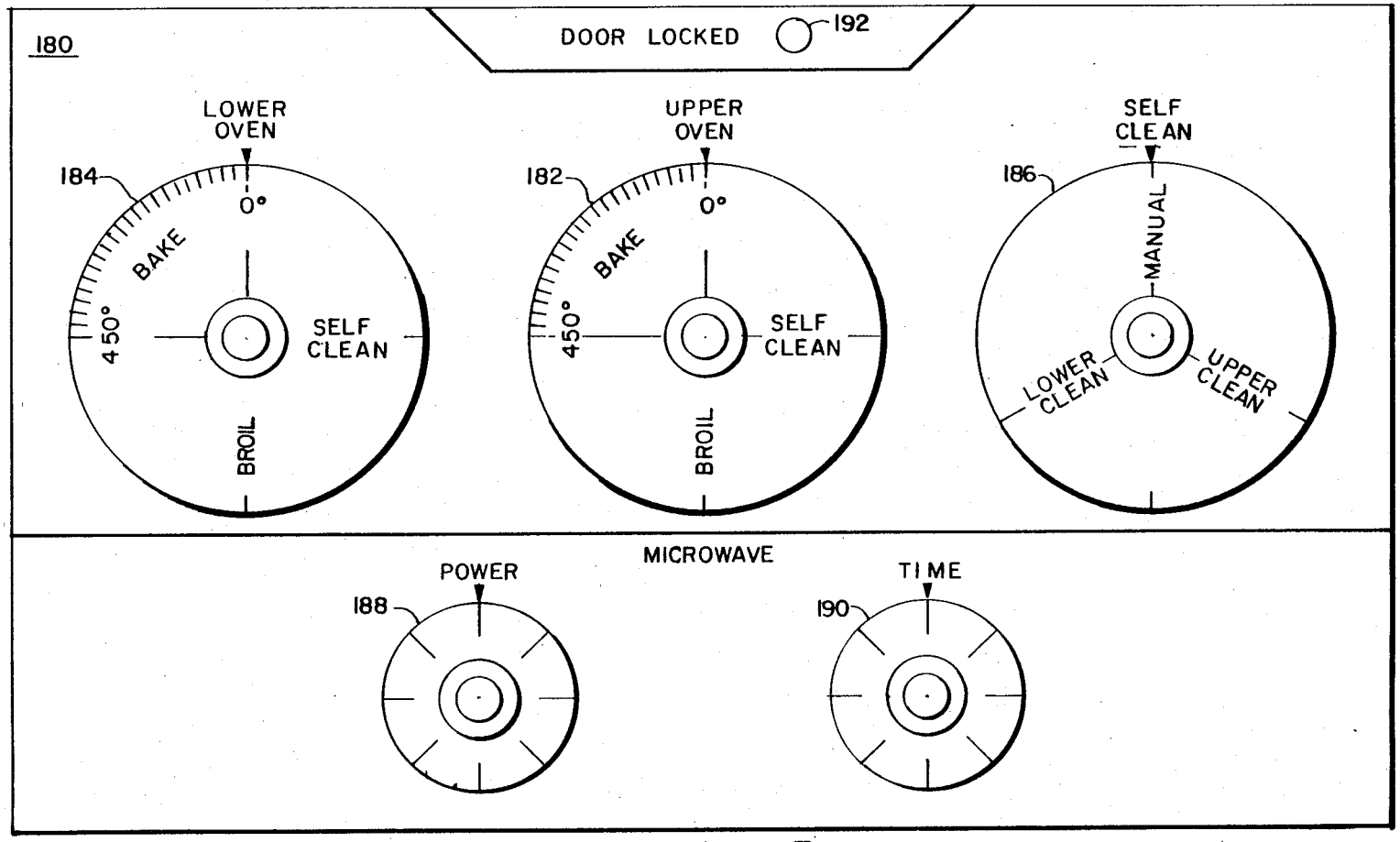
FIG. 5 is an expanded plan view of the control panel not drawn to scale.

Referring to FIG. 5, a nonscalar view of control panel 180 is shown. Upper oven selector dial 182 is used to set the operating mode of upper oven cavity 44 to bake, broil or self-clean. Further, if the bake mode is selected, selector dial 182 is used to set the operating temperature for cavity 44. Similarly, lower oven selector dial 184 is used to select bake, broil, or self-clean as the operating mode of lower oven cavity 14, and if bake is selected, to set the temperature. Initiation of self-clean mode in either cavity 14 or 44 also requires self-clean dial 186 to be set appropriately to either the lower clean setting or the upper clean setting. Thus, simultaneous self-cleaning of both oven cavities cannot be selected. However, when self-clean dial 186 is set to lower clean, upper oven cavity 44 may still operate in bake or broil as set by upper oven selector 182. Likewise, when self-clean dial 186 is set to upper clean, lower cavity 14 may still operate in bake or broil as set by lower oven selector 184. Finally, setting dial 186 to manual may enable all modes of operation except self-clean in oven cavities 14 and 44. Microwave power selector dial 188 is used to set the microwave power level. Microwave time selector 190 sets the time duration of microwave cooking. Door locked indicator light 192 provides a visual indication of when door 24 or 54 is locked.

Although control panel 180 is shown with mechanical dials, those skilled in the art will recognize that other operator actuable devices such as, for example, digital touch pads may be used. Other indicator lights such as, for example, a preheat light to indicate when either oven cavity 14 or 44 is rising to a selected temperature may also be utilized. In addition, other modes of operations such as, for example, cooking at a preselected future time, or cooking for a preselected time duration, or a combination microwave and thermal cooking, are not described because a detailed description of them is not necessary for an understanding of the invention.

Referring to FIG. 6, a control circuit for double wall oven 12 is shown. Temperature sensor 72, temperature sensor 70 and control panel 180 are each connected to digital controller 74. Control panel 180 functions to provide an operator interface for selecting the modes and parameters described with reference to FIG. 5. Lower temperature sensor 72 and upper temperature sensor 70 each provide a signal corresponding to temperature in cavities 14 and 44, respectively. Controller 74 may be any suitable controlling device operable according to the functions described herein and may typically be an electromechanical controller, digital controller, or a combination of both. As described herein, controller 74 is a digital controller such as a conventional integrated circuit microprocessor. Controller 74 operates in a conventional manner to enable heating elements 26, 30, 56 and 60, magnetron 84 and blower 152 in the operating modes discussed above. For example, during lower bake mode, lower cavity 14 bake temperature is selected using lower oven selector dial 184. In response to the input from control panel 180 and temperature sensor 72, controller 74 controls bake element 26 to maintain the selected temperature. During lower self-clean mode, controller 74 enables bake element 26 and broil element 30 in response to control panel 180. It may be preferable for controller 74 to alternately pulse heating elements 26 and 30 to efficiently circulate air through lower cavity 14 while self-cleaning. Desirable self-cleaning results are provided by activating bake element 26 for a duty cycle of 67 percent and broil element 30 for a duty cycle of 33 percent, both within a period of two minutes. Upper cavity 44 bake, broil and self-clean modes are controlled by controller 74 in a similar manner. Upper bake element 56, broil element 60 and temperature sensor 70 have identical funtions to their corresponding parts in lower oven cavity 14. However, during upper cavity 44 self-cleaning, controller 74 also activates blower 152 to repel hot self-clean air from entering waveguide 92. In addition, controller 74 will not initiate self-cleaning of oven cavities 14 or 44 unless the respective oven door 24 or 54 is latched as detected by lower door latch switch 346 or upper door latch switch 246, respectively. In this manner, inadvertent operator exposure to air from oven cavities 14 or 44 during self-cleaning is avoided. For additional operator protection, controller 74 provides door locking signals on lines 274 or 284 when cavities 14 or 44, respectively, are above a predetermined lock temperature. Signals on lines 274 or 284 are used to lock oven doors 24 or 54, respectively, during self-cleaning, as will be discussed below. It may also be preferable for controller 74 to prevent activation of simultaneous self-cleaning, preferably in configurations wherein the control panel permits simultaneous self-cleaning. Finally, during microwave cooking, controller 74 activates magnetron power supply 94 and magnetron blower 152 in response to control panel 180.

Continuing with FIG. 6, components are illustrated in states corresponding to conditions wherein oven cavities 14 and 44 are cool, oven doors 24 and 54 are open, heating elements 26, 30, 56 and 60 are not activated, magnetron 84 is off and magnetron blower 152 is off. Conventional 240 volts AC is provided at line terminals L2 and L1. Neutral is provided at line terminal N. All electrical grounds, designated throughout FIG. 6 by the conventional electrical ground symbol, are tied to N. Lower bake element 26, switch 194 of relay 196 and switch 198 of lower oven limit temperature control 82 are connected in series between L1 and L2. Lower broil element 30, switch 202 of relay 204 and switch 198 are also connected in series between L1 and L2. Coil 200 of relay 196 and coil 206 of relay 204 are separately connected to controller 74. Accordingly, lower bake element 26 and lower broil element 30 are separately enabled in response to controller 74. Similarly, upper oven bake element 56, switch 224 of relay 226 and switch 228 of upper oven limit temperature control 80 are connected in series between L1 and L2. Upper oven broil element 60, switch 232 of relay 234 and switch 228 of upper oven limit temperature control 80 are also connected in series between L1 and L2. Coil 230 of relay 226 and coil 236 of relay 234 are separately connected to controller 74. Accordingly, controller 74 enables upper heating elements 56 and 60 in the same manner as in lower cavity 14 previously discussed.

Magnetron 84 is shown coupled to power supply 94. Switch 240 of relay 242 and magnetron power supply 94 are connected in series to L2. Coil 244 of relay 242 is connected to controller 74 through line 238. Upper door latch switch 246 is connected between ground and controller 74. Switch 246 couples ground to controller 74 when door 54 is latched. Controller 74 energizes coil 244 through line 238, closing switch 240, coupling L2 to power supply 94 and activating magnetron 84. Using a conventional interlock, controller 74 will not activate magnetron 84 through line 238 unless door 54 is detected as being latched. Operator exposure to microwave energy by inadvertent opening of door 54 is therefore prevented.

Magnetron blower 152 has two voltage input terminals 248 and 250. Temperature sensitive switch 252, switch 254 of relay 256, and switch 260 of relay 262 are connected in parallel between terminal 248 and L2. Terminal 250 and door latch switch 246 are connected in series to ground. It follows, then, that if any of switches 252, 254 or 260 are closed when door latch switch 246 is closed, blower 152 is activated. Switch 254, here shown activated by relay coil 258 connected to controller 74 via line 238, enables blower 152 during microwave operation in response to controller 74. Power supply 94, magnetron 84, and magnetron output probe 88 are thereby cooled. In addition, cavity 44 air is thereby purged during microwave operation as described previously herein. Similarly, switch 260, activated by relay coil 264 connected to controller 74, enables blower 152 during self-clean mode in response to controller 74. Hot self-clean air is then repelled from entering waveguide 92 as discussed previously. An alternate embodiment is to activate magnetron blower 152 solely by upper oven door latch switch 246. Since both microwave and self-clean modes require upper oven door 54 to be latched, blower activation by door latch switch 246 may be sufficient. It may also be desirable to activate magnetron blower 152 during thermal cooking. For example, simultaneous thermal cooking in lower oven cavity 14 and upper oven cavity 44 may result in compartment 150 having temperatures detrimental to electrical component life. A temperature sensing switch 252 located in compartment 150, may be calibrated to activate blower 152 when an undesirable temperature is detected. It has been determined that temperature sensitive switch 252 should be activated at temperatures of approximately 200° F.

Referring to FIGS. 1 and 6, lower latching member 36 latches to latching receptacle 34 of door 24 in response to latch handle 38. Lower solenoid 268 is coupled to handle 38. Solenoid 268, operator actuated momentary switch 270 and lock switch 272 are connected in series between ground and L2. Lower oven lock switch 272 is coupled to controller 74 by line 274. When switch 272 is closed and switch 270 is depressed, the L2 to ground voltage drop energizes solenoid 268 and latch handle 38 is then free to move. However, in response to lower oven temperature sensor 72, controller 74 provides a signal on line 274 which opens lock switch 272 when lower oven cavity 14 rises above a predetermined lock temperature. Accordingly, when cavity 14 is above lock temperature, latching handle 38 is locked in place preventing the operator from opening door 24 and becoming exposed to hot air from oven cavity 14. Upper door 54 is locked in the same manner as described for lower door 24. Upper door 54, latching receptacle 64, latching member 66, latching handle 68, solenoid 278, momentary switch 280, lock switch 282 and controller 74 output line 284 have similar functions to their corresponding parts in lower oven cavity 14. It has been determined that the predetermined lock temperature may preferably be approximately 600° F. Those skilled in the art will recognize that other lock temperatures may be appropriate.

Lower lock switch 272 is also connected between ground and side 286 of door locked indicator light 192. Coil 290 is connected between L2 and side 286 of light 192. Upper lock switch 282 is connected between ground and side 288 of light 192. Solenoid 278 and resistor 292 are connected in series between L2 and side 288 of light 192. Accordingly, when either lower oven cavity 14 or upper cavity 44 is above 600° F., door locked indicator light 192 is activated.

A temperature control circuit is now described which limits cavities 14 or 44 to a safe temperature, under conditions wherein component failure results in an undesired and hazardous operating mode. Upper oven limit temperature control 80 includes: control switch 228, activating resistor 296, temperature sensitive switches 300 and 302, and limit temperature sensor 76. End 294 of resistor 296 is connected to L1. Temperature sensitive switch 300 is connected between opposite end 298 of resistor 296 and ground. Temperature sensitive switch 302 is connected between end 298 of resistor 296 and line 304. Limit temperature sensor 76 is coupled to switches 300 and 302. If cavity 44 is above a first predetermined temperature, here 505° F., limit temperature sensor 76 causes normally closed contacts of switch 300 to open. Also, if cavity 44 is above a second predetermined temperature, here 925° F., limit temperature sensor 76 causes normally closed contacts of switch 302 to open. A voltage drop of L1 to ground across resistor 296 closes switch 228. Accordingly, when cavity 44 is below 505° F., ground is coupled to end 298 of resistor 296 through switch 300, closing control switch 228. For cavity 44 temperatures up to 925° F., line 304 is coupled to end 298 of resistor 296 through switch 302. If ground is then coupled to line 304, control switch 228 will be closed. When cavity 44 is above approximately 925° F., both switches 300 and 302 are open, ground is isolated from end 298 of resistor 296 and control switch 228 will be open. Upper oven limit temperature control 80 functions in a similar manner to lower oven limit temperature control 82, which will be described later herein. Limit temperature control 80 and 82 are commonly available parts, such as, for example, Essex Part No. 513-800.

Generally, as previously discussed, control switch 228 must be closed to enable activation of heating elements 56 and 60. For cavity 44 temperatures below 505° F., relay switch 228 is always closed, thus, heating elements 56 and 60 are controlled only by controller 74 through activation of relays 226 and 234, respectively. At cavity 44 temperatures above 925° F., relay switch 228 is always open disabling heating elements 56 and 60. That is, upper cavity 44 is limited to 925° F. which is the maximum desired temperature for self-cleaning by pyrolysis. For cavity 44 temperatures between 505° F. and 925° F., control switch 228 is closed only if ground is coupled to line 304. Specifically, switch 306 of upper self-clean prevent relay 308, blower detector switch 352 and upper latch switch 246 are connected in series between line 304 and ground. Coil 290 of relay 308 and lower cavity lock switch 272 are connected between L2 and ground. Accordingly, when lower cavity 14 is above 600° F., lock switch 272 opens, de-energizing coil 290 and opening switch 306, which isolates ground from line 304. Upper oven cavity 44 will then be limited to 505° F. by switches 300 and 228 which is the desired result. That is, upper oven limit temperature control 80 prevents cavities 14 and 44 from both being in self-clean simultaneously. Similarly, when forced air from blower 152 is not detected, blower air detector switch 352 remains open preventing ground from coupling to line 304. Again, upper cavity 44 will be limited to 505° by temperature sensitive switch 300 and switch 228. Thus, when blower air is not detected, upper oven cavity 44 is limited to 505° F. which is an insufficient temperature to damage electrical components such as plastic drive shaft 130 located in waveguide 92. Finally, when upper oven door 54 is not latched, upper door latch switch 246 remains open preventing ground from coupling to line 304. With upper oven door 54 not latched, upper oven cavity 44 is limited to a safe temperature of 505° F. for operator exposure.

Safe limiting of lower oven cavity 14 temperature is accomplished in almost an identical manner. Lower oven limit temperature control 82 includes: control switch 198, lower oven limit temperature sensor 78, temperature sensitive switch 330 connected to ground, temperature sensitive switch 332 connected to line 334, and activating resistor 326. Switch 336 of lower self-clean prevent relay 338 and lower door latch switch 346 are connected in series between ground and line 334. Coil 320 of relay 338 and upper cavity lock switch 282 are connected in series between ground and L2. Accordingly, when upper cavity 44 rises above 600° F., switch 282 couples ground to coil 320, opening switch 336 and isolating ground from line 334. Lower cavity 14 will then be limited to 505° F. by temperature sensitive switch 330. When lower oven door 24 is not latched, lower latch switch 346 remains open preventing ground from coupling to line 334. Lower oven cavity 14 is then limited to a safe temperature for operator exposure of 505° F.

In summary, upper limit temperature control 80 will limit cavity 44 temperature to a safe 505° F. if a failure in controller 74, or any component shown in FIG. 6, enables any of the following undesired modes: simultaneous self-cleaning of cavities 14 and 44, upper cavity 44 self-cleaning without operation of blower 152, cavity 44 self-cleaning without latching of door 54. Thus, the hazards discussed herein will be avoided by limiting cavity 44 to a safe temperature above the thermal cooking temperature range such that cavity 44 may still be used for cooking. Lower limit temperature control 82 will safely limit lower cavity 14 in the same manner, as described herein.

This concludes the Description of the Preferred Embodiment. The reading of it by those skilled in the art will bring to mind many alterations and modifications without departing from the spirit and scope of the invention. Accordingly, it is intended that the scope of the invention be limited only by the following claims.

What is claimed is:

1. In combination:

a first oven cavity;

a source of thermal energy for heating said first oven cavity for cooking and self-cleaning;

a second oven cavity adjacent to said first oven cavity;

a source of thermal energy for heating said second oven cavity for cooking and self-cleaning;

means coupled to said first oven cavity for providing a signal when said first oven cavity rises above a first predetermined temperature;

a temperature sensor coupled to said second oven cavity; and means responsive to both said signal and said second oven cavity temperature sensor for preventing said first oven cavity from rising above said first predetermined temperature when said second oven cavity is above a second predetermined temperature.

2. The combination recited in claim 1 wherein said first source of thermal energy comprises an electric heating element positioned in said first oven cavity, and said second source of thermal energy comprises an electric heating element positioned in said second oven cavity.

3. The combination recited in claim 2 wherein said preventing means comprises a switch for disabling said first oven cavity electric heating element.

4. The combination recited in claim 1 further comprising an operator actuable control having a first setting corresponding to self-cleaning in said first oven cavity and a second setting corresponding to self-cleaning in said second cavity, said first and second settings not being simultaneously actuable.

5. The combination recited in claim 1, wherein said first oven cavity is positioned above said second oven cavity.

6. A double wall oven, comprising:

a first oven cavity;

an electric heating element positioned in said first oven cavity;

a second oven cavity adjacent to said first oven cavity;

an electric heating element positioned in said second oven cavity;

means for providing a first signal when said first oven cavity rises above a predetermined temperature in said first oven cavity;

a temperature sensor coupled to said second oven cavity;

a controller comprising means for controlling activation of said first oven cavity electric heating element and said second oven cavity electric heating element for cooking and self-cleaning, said controller further comprising means responsive to said second oven cavity temperature sensor for providing a second signal when said second oven cavity rises above a predetermined temperature; and means responsive to both said first signal and said second signal for disabling said first oven cavity electric heating element at said predetermined temperature in said first oven cavity, said disabling means also disabling said first oven cavity electric heating element at an upper limit self-cleaning temperature in said first oven cavity, said disabling means comprising a switch.

7. The double wall oven recited in claim 6 further comprising means for coupling a third signal to said disabling means when said first oven cavity rises above said upper limit self-cleaning temperature, said coupling means being coupled to said first oven cavity.

8. The double wall oven recited in claim 6 wherein said controller also comprises means for preventing activation of said first oven cavity electric heating element for self-cleaning when said second oven cavity electric heating element has been activated for self-cleaning.

9. The double wall oven recited in claim 6 wherein said first oven cavity is above said second oven cavity.

10. A double wall oven, comprising:

a first oven cavity having an air inlet port;

an electric heating element positioned in said first oven cavity for cooking and self-cleaning;

a magnetron;

a waveguide for coupling microwave energy from said magnetron to said air inlet port;

a blower for forcing air across said magnetron, through said waveguide, through said air inlet port into said first oven cavity;

a second oven cavity adjacent to said first oven cavity;

an electric heating element positioned in said second oven cavity for cooking and self-cleaning;

a temperature sensor coupled to said second oven cavity;

a controller for controlling activation of said electric heating elements, said magnetron and said blower, said controller further comprising means responsive to said temperature sensor for providing a first signal when said second oven cavity rises above a predetermined second oven cavity temperature;

means for providing a second signal when air flow from said blower is absent; and means responsive to said second signal for disabling said first oven cavity electric heating element at a predetermined first oven cavity temperature, said disabling means also being responsive to said first signal for disabling said first oven cavity electric heating element at said predetermined first oven cavity temperature, said disabling means also disabling said first oven cavity electric heating element at an upper limit self-cleaning temperature in said first oven cavity, said disabling means comprising a switch.

11. The double wall oven recited in claim 10 further comprising a means for coupling a third signal to said disabling means when said first oven cavity rises above said predetermined first oven cavity temperature, said coupling means also coupling a fourth signal to said disabling means when said first oven cavity rises above said upper limit self-clean temperature, said coupling means being coupled to said first oven cavity.

12. The double wall oven recited in claim 11 wherein said controller also activates said blower during self-cleaning of said first oven cavity.

13. The double wall oven recited in claim 10 wherein said controller also comprises means for preventing simultaneous self-cleaning of said first oven cavity and said second oven cavity.

14. The double wall oven recited in claim 10 wherein said first oven cavity comprises a back wall, a top wall, a bottom wall, and two side walls, said air inlet port being in said back wall.

15. The double wall oven recited in claim 10 further comprising an operator actuable control coupled to said controller, said control having a first setting corresponding to self-cleaning in said first oven cavity and a second setting corresponding to self-cleaning in said second cavity, said first and second settings not being simultaneously actuable.

16. A double wall oven, comprising:

a first oven cavity;

a source of thermal energy for heating said first oven cavity for cooking and self-cleaning;

a second oven cavity located above said first oven cavity;

a source of thermal energy for heating said second oven cavity for cooking and self-cleaning;

a temperature sensor coupled to said second oven cavity; and means responsive to said temperature sensor for disabling said first oven cavity source of thermal energy at a first predetermined temperature in said first oven cavity when said second oven cavity rises above a second predetermined temperature in said second oven cavity.

17. A method for preventing a first oven from self-cleaning when an adjacent second oven is self-cleaning, comprising the steps of:

detecting when said second oven rises above a first predetermined temperature corresponding to self-cleaning; and limiting said first oven to a second predetermined temperature in response to detecting said second oven above a first predetermined temperature.

* * * * *